US005826272A

United States Patent [19]

Hong

[11] Patent Number: 5,826,272

[45] Date of Patent: Oct. 27, 1998

[54] VISORED GOLF CAP

[76] Inventor: Bum-Ki Hong, 105-903, Hyundai first APT, 653 Gaepo-dong, Kangnam-gu, Seoul, Rep. of Korea

[21] Appl. No.: 759,789

[22] Filed: Dec. 3, 1996

[30] Foreign Application Priority Data

Dec. 6, 1995 [KR] Rep. of Korea ..... 95-38613

[51] Int. Cl.[6] ..... A61F 9/00

[52] U.S. Cl. ..... 2/12; 2/209.13; 2/209.3

[58] Field of Search ..... 2/12, 175.1, 175.5, 2/195.1, 195.6, 209.3, 425, 209.13

*Primary Examiner*—Diana Biefeld

*Attorney, Agent, or Firm*—Abelman, Frayne & Schwab

[57] ABSTRACT

A visored golf cap with a measuring means is disclosed. In the cap, a front visor is attached to the front part of a size-adjustable head band. The regularly-spaced visor holders are radially attached to all the opposite side parts of the band except for the front part. The flexible fabric visors cover the intervals between the front visor and the visor holders, respectively. The visor coupling plate is coupled to either one of the two endmost visor holders through a corrugated flexible connector. The visored cap effectively screens the sun's rays that are radiated onto both side parts of a golfer's face and onto a golfer's neck. Due to the measuring means attached to the front visor, a golfer while golfing effectively checks the distance between a golf ball and a target point and checks the inclination angle of a slope where the golf ball must roll in order to reach a target hole.

2 Claims, 2 Drawing Sheets

VISORED GOLF CAP

BACKGROUND OF THE INVENTION

1. Field of the Invention

The present invention relates, in general, to visored golf caps and, more particularly, to a structural improvement in such caps for providing a visor on the overall length of a size-adjustable head band and giving the visor's front part a measuring means for assisting a golfer while measuring a target direction, target distance or inclination angle of a slope on a golf course.

2. Description of the Prior Art

In a typical visored golf cap with a size-adjustable head band, the visor sticks out at the front of the strip-shaped band exclusively, so that the visor fails to screen the sun's rays that are radiated onto both side parts of a golfer's face and onto a golfer's neck. The typical golf caps are not provided with a measuring means for assisting a golfer while measuring a target direction, target distance or inclination angle of a slope on a golf course.

SUMMARY OF THE INVENTION

It is, therefore, an object of the present invention to provide a structurally-improved golf cap in which the above problems can be overcome and to provide a golf cap which has a visor attached to a size-adjustable head band on the overall length, with the visor's front part having a means for assisting a golfer while measuring a target direction, target distance or inclination angle of a slope on a golf course.

In order to accomplish the above object, the present invention; a visored golf cap comprising a size-adjustable head band having a strip shape, a front visor attached to a front part of the strip-shaped band corresponding to the forehead of a user, a plurality of regularly-spaced visor holders radially attached to all the opposite side parts of the band except for the front part, a plurality of flexible fabric visors covering the intervals between the front visor and the visor holders, respectively, a visor coupling plate coupled to either one of the two endmost visor holders through a corrugated flexible connector, means for adjusting the size of the band in accordance with the size of the head, the size adjusting means being provided on both ends of the band and on the visor coupling plate, and on the other endmost visor holder, and means for measuring a target direction, a target distance or an inclination angle of a slope on a golf course.

In an embodiment, the measuring means comprises a radial slit formed on the central portion of the front visor, a hinge holder set in the radial slit, a vertical bar rotatably jointed to the hinge holder by a hinge shaft, and two horizontal bars fixed to the free end portion of the vertical bar, the horizontal bars being parallel to each other and crossing at right angles with the vertical bar.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Figure 1:
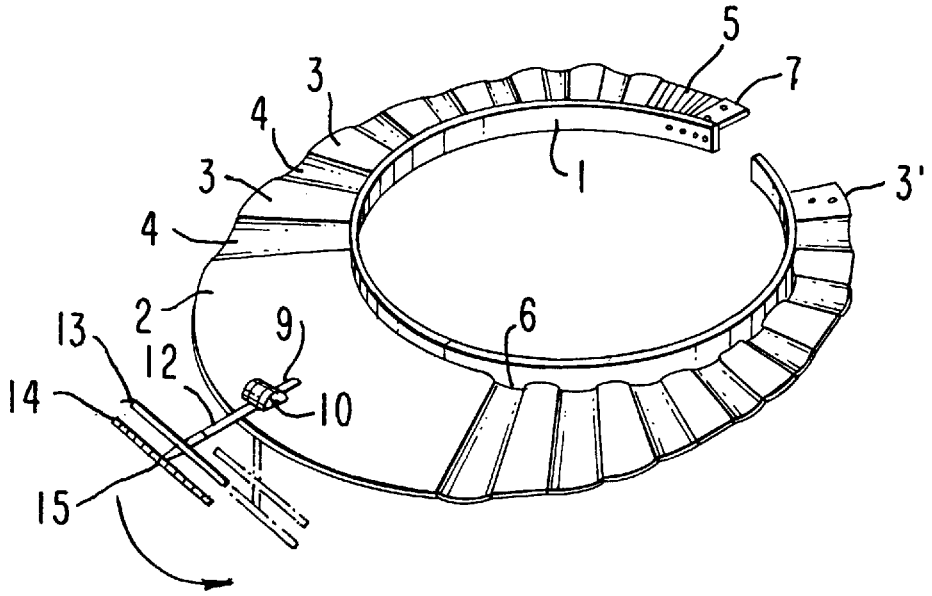
FIG. 1 is a perspective view showing the configuration and construction of a visored golf cap in accordance with the preferred embodiment of the present invention.
Figure 2:
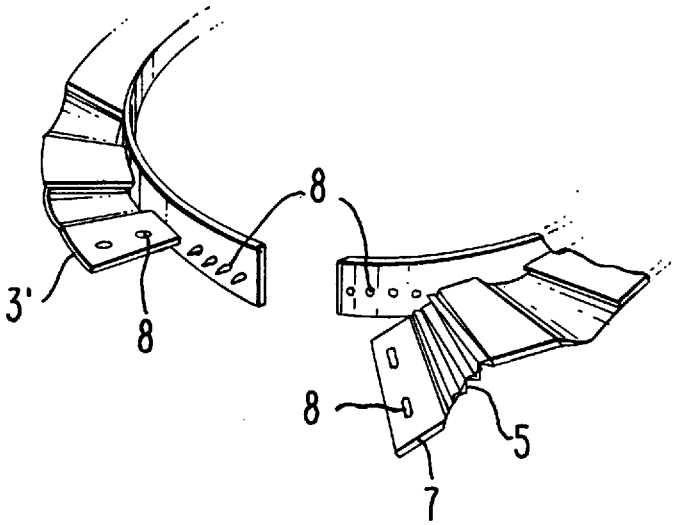
FIG. 2 is a perspective view showing the construction of the opposite ends of the size-adjustable head band included in the cap of this invention.
Figure 3:
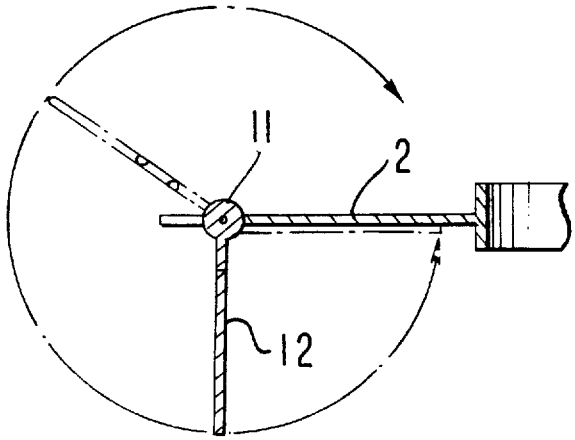
FIG. 3 is a sectional view showing the construction and operation of a measuring means provided on the front part of the cap's visor according to this invention.

FIGS. 1 to 3 show the configuration, construction and operational effect of a visored golf cap according to the preferred embodiment of this invention.

As shown in the drawings, the golf cap of this invention includes a size-adjustable head band 1 which has a strip shape. A front visor 2 sticks out at the front part of the band 1 corresponding to the forehead of a golfer, while a plurality of regularly-spaced visor holders 3 are radially attached to the opposite side parts of the band 1 except for the front part. The openings between the front visor 2 and the holders 3 are closed by a plurality of flexible fabric visors 4, respectively. A visor coupling plate 7 is coupled to one endmost visor holder 3', which is provided on one end of the band 1, through a corrugated flexible connector 5.

The cap also has a band-size adjusting means 8. In the preferred embodiment, the band-size adjusting means 8 comprises a plurality of first fitting holes, which are longitudinally arranged on one end of the band 1 with regular intervals. Meanwhile, a plurality of first fitting protrusions are arranged on the other end of the band 1. The first fitting protrusions are selectively fitted into the first holes, so that the size of the band 1 can be freely adjusted in accordance with the size of the head. The adjusting means 8 also comprises a plurality of second fitting protrusions, which are formed on the coupling plate 7, and a plurality of second fitting holes which are formed on the other endmost visor holder 3'.

The cap further includes a measuring means which is used for assisting a golfer while measuring a target direction, target distance or inclination angle of a slope on a golf course. The measuring means comprises a slit 9 which is formed by radially slitting the central portion of the front visor 2 from the edge to a given length. A hinge holder 10 is set in the radial slit 9 and rotatably holds a vertical bar 12. One end of the vertical bar 12 is jointed to the holder 10 by a hinge shaft 11, so that the bar 12 is rotatable around the holder 10. Two horizontal bars, that is, first and second horizontal bars 13 and 14 are fixed to the other end portion of the vertical bar 12. The above horizontal bars 13 and 14 are parallel to each other and cross at right angles with the vertical bar 12.

In the drawings, the reference numeral 6 denotes a gap formed between the head band 1 and each flexible fabric visor 4, and the numeral 15 denotes graduations marked on the measuring means.

The operational effect of the cap of this invention will be described hereinbelow.

Prior to putting on the cap, the size of the head band 1 is preferably adjusted in order to fit the cap to the head by manipulating the size adjusting means 8 in accordance with the size of the head. Primarily, the first protrusions are selectively fitted into the first holes, thereby fastening the ends of the band 1 together while adjusting the size of the band 1. In the above state, the intervals between the front visor 2 and the visor holders 3 are changed in accordance with the adjusted size of the band 1. However, the changed intervals are effectively covered by the fabric visors 4 due to both the flexibility of the fabric visors 4 and the gaps 6 formed between the visors 4 and the band 1. That is, the fabric visors 4 may be stretched or sag in accordance with the adjusted diameter of the band 1. After fastening the ends of the band 1 together, the second protrusions of the visor coupling plate 7 are fitted into the second holes of the endmost visor holder 3', so that the band 1 is visored on the overall length. When putting on the above cap while golfing, the visored cap effectively screens the sun's rays that are radiated onto both side parts of a golfer's face and onto a golfer's neck.

In order to measure the distance between a golf ball and a target point with the measuring means while golfing, a golfer wearing the cap primarily looks down the golf ball so as to align the ball with the cross point between the vertical bar 12 and the first horizontal bar 13. The golfer secondarily looks at the target point such as a target hole or flagpole on a golf course while checking which graduation 15 is aligned with the target point. Thereafter, the golfer counts the number of graduations 15 from the cross point between the two bars 12 and 13 to the graduation 15 aligned with the target point. The golfer thus almost precisely measures the distance between the ball and the target point with the measuring means. In order to measure an inclination angle of a slope where a golf ball must roll in order to reach a target hole, a golfer checks how much inclined is a flagpole or slope relative to either the vertical bar 12 or the first horizontal bar 13. The golfer thus almost precisely measures the inclination angle of a slope with the measuring means. After determining a target direction, the golfer selects a target item which is placed in the target direction at a position spaced from the golf ball by about 1 meter. Thereafter, the hinged vertical bar 12 is rotated around the holder 10 in order to cause both the ball and the target item to be tangent or parallel to the first horizontal bar 13. The bar 12 in turn is fixed to the adjusted position. Thereafter, the golfer stands with both feet being tangent or parallel to the second horizontal bar 14, thereby positioning both feet parallel to the target direction. The golfer in the above position can hit the golf ball in the target direction without failure.

When it is necessary to position a line, extending between a golf ball and a left foot, at right angles with a target direction, a golfer primarily looks down the golf ball so as to align the ball with the cross point between the vertical bar 12 and the first horizontal bar 13. Thereafter, the left foot is positioned in order to be aligned with the cross point between the vertical bar 12 and the second horizontal bar 14.

As described above, the present invention provides a visored golf cap provided with a measuring means. In the cap of this invention, the visor is provided on the size-adjustable head band thoroughly, so that the cap effectively screens the sun's rays that are radiated onto both side parts of a golfer's face and onto a golfer's neck. Due to the measuring means, a golfer while golfing almost precisely checks the distance between a golf ball and a target point and checks the inclination angle of a slope where the golf ball must roll in order to reach a target hole. The above measuring means is also used for positioning both feet parallel to a target direction.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A visored golf cap comprising:

a size-adjustable head band having a strip shape;

a front visor attached to a front part of said head band corresponding to a forehead of a user;

a plurality of regularly-spaced visor holders attached to the entire length of said head band except for the front part of said head band, said visor holders being attached to said head band such that each of said visor holders project outwardly with respect to a wearer's head;

a plurality of flexible fabric visors covering intervals between said front visor and two of said visor holders adjacent to said front visor, and intervals between each adjacent pair of visor holders;

a visor coupling plate coupled to either one of two visor holders closest to either end of said head band, said visor coupling plate being coupled through a corrugated flexible connector;

means for adjusting the size of said band in accordance with the size of the wearer's head, said size adjusting means being provided on both ends of said band and on said visor coupling plate, and on one of said two visor holders closest to either end of said head band, said one visor holder not being coupled to said visor coupling plate through said corrugated flexible container; and means for measuring a target direction, a target distance or an inclination angle of a slope on a golf course.

2. The visored golf cap according to claim 1, wherein said measuring means comprises:

a radial slit formed on a central portion of said front visor;

a hinge holder set in said radial slit;

a vertical bar rotatably jointed to said hinge holder by a hinge shaft; and two horizontal bars fixed to a free end portion of said vertical bar, said horizontal bars being parallel to each other and crossing at right angles with the vertical bar.

* * * * *